United States Patent [19]

Rao et al.

[11] 4,170,620

[45] Oct. 9, 1979

[54] PROCESS FOR MAKING AND ASSEMBLING A ROTARY REGENERATOR AND DRIVE GEAR CONSTRUCTION

[75] Inventors: V. Durga Nageswar Rao, Bloomfield Hills; Christian J. Rahnke, Orchard Lake; Carlo A. Fucinari, Southfield; James K. Vallance, Northville, all of Mich.

[73] Assignee: Ford Motor Company, Dearborn, Mich.

[21] Appl. No.: 864,079

[22] Filed: Dec. 23, 1977

[51] Int. Cl.[2] ..... B29D 3/00; B29D 15/00; B29H 3/00

[52] U.S. Cl. ..... 264/230; 264/262; 264/271; 264/138; 264/334

[58] Field of Search ..... 264/261, 262, 271, 230, 264/342 R, 334; 165/8

[56] References Cited

U.S. PATENT DOCUMENTS

| | | | |
|---|---|---|---|
| 1,686,142 | 10/1928 | Bonsieur | 264/262 |
| 1,742,625 | 1/1930 | Weckerle | 264/262 |
| 1,816,023 | 1/1931 | Osborne | 264/262 |
| 1,952,446 | 3/1934 | Maas | 264/262 |
| 1,958,141 | 5/1934 | Haushalter | 264/262 |
| 2,258,810 | 10/1941 | Rabezzana et al. | 264/262 |
| 2,554,008 | 5/1951 | Burger | 265/262 |
| 2,616,481 | 11/1952 | Twells et al. | 264/262 |
| 2,689,755 | 9/1954 | Krotz | 264/262 |
| 3,608,049 | 9/1971 | Tavella | 264/262 |

FOREIGN PATENT DOCUMENTS

| | | | |
|---|---|---|---|
| 243518 | 12/1925 | United Kingdom | 264/262 |
| 1308168 | 2/1973 | United Kingdom | 165/8 |

*Primary Examiner*—Willard E. Hoag
*Attorney, Agent, or Firm*—Donald J. Harrington; Keith L. Zerschling

[57] ABSTRACT

A process for making and assembling a rotary regenerator comprising a ceramic core adapted to rotate upon its central axis and a ring gear surrounding the periphery of the core for purposes of driving the core rotatably including preparing and forming a yieldable compliant ring sandwiched between the ring gear and the periphery of the core to prevent stresses in the core caused by differential rates of expansion of the core and the ring during operation of the regenerator in a gas turbine engine and during processing of the regenerator and the regenerator drive ring.

6 Claims, 28 Drawing Figures

FIG. 6.
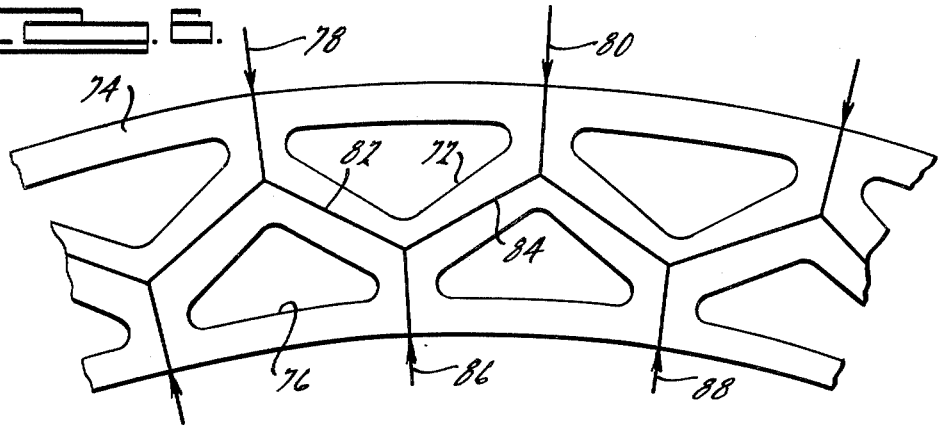
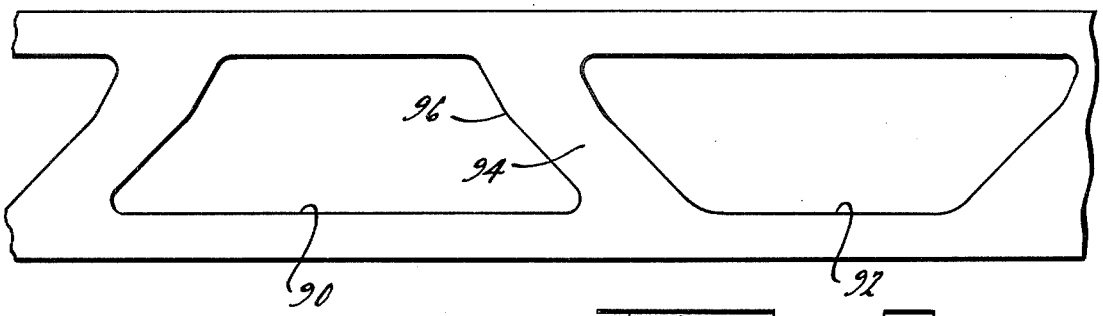
FIG. 7.
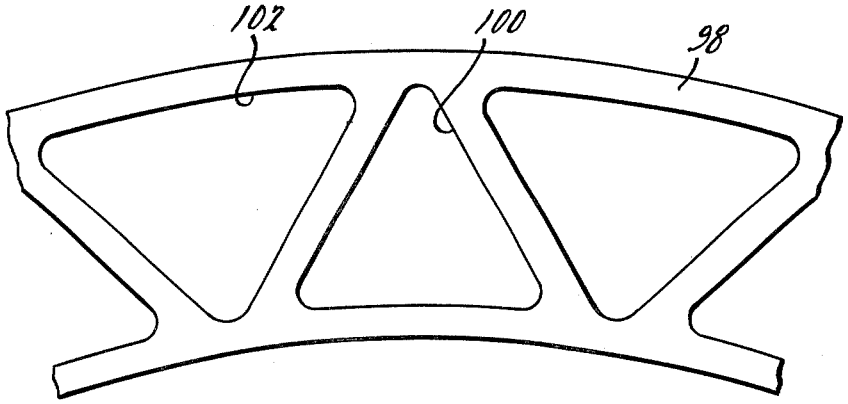
FIG. 8.
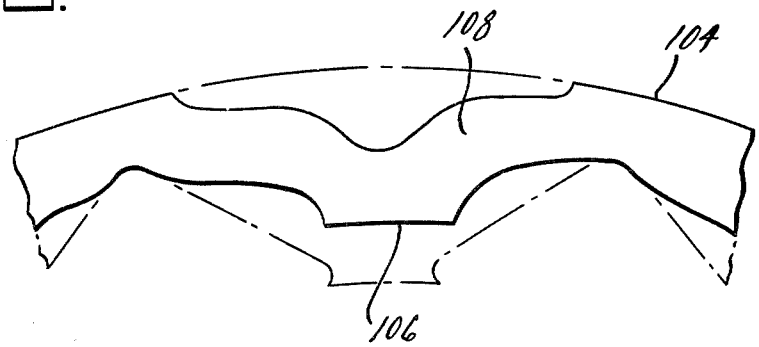
FIG. 8A.

PROCESS FOR MAKING AND ASSEMBLING A ROTARY REGENERATOR AND DRIVE GEAR CONSTRUCTION

REFERENCE TO RELATED DISCLOSURE

This disclosure is related to co-pending patent application, Ser. No. 864,078 filed concurrently herewith by V. Durga Nageswar Rao, entitled "REGENERATOR AND DRIVE GEAR CONSTRUCTION." That application is assigned to the assignee of this application.

GENERAL DESCRIPTION OF THE INVENTION

Our invention relates to methods for making rotary regenerators for use with an external combustion engine, such as a gas turbine engine, where heat is recovered from the engine exhaust and transferred to the engine intake gases to raise the temperature of the intake gases thus improving combustion efficiency of the burner for the engine. The regenerator core constructed of a glass ceramic material ($2M_gO.2Al_2O_3.5SiO_2$) in the form of a cylinder is rotatable about its central axis during operation. The cylindrical core is surrounded by a ring gear which powers a regenerator, and the ring gear is yieldably connected to the ceramic core by elastomer material.

The ring is formed of steel and its rate of thermal expansion differs substantially from the rate of thermal expansion of the glass ceramic regenerator core. The elastomeric material accommodates differential rates of expansion that occur during operation of the regenerator as well as during the processing of the core and the ring gear assembly. Increased compliance of the ring gear with respect to the core is achieved thereby preventing an undesirable radial force transfer between the ring gear and the core which would tend to cause failure of the glass ceramic material of which the regenerator core is formed. This is done without reducing to an unacceptable level the ability of the elastomer to transmit tangential forces between the ring gear and the core.

The compliance of the ring gear with respect to the core during differential expansion is achieved by providing a space or cavity within the elastomer at strategic locations. These cavities permit compliance in both a radial direction and in a tangential direction. As the ring gear is displaced radially relative to the core by reason of differential rates of expansion and as the ring gear is displaced relative to the core in a tangential direction by reason of the driving forces transmitted between them, excessive stresses in the glass ceramic of the core are eliminated and cracking of the regenerator core is avoided.

BRIEF DESCRIPTION OF THE FIGURES OF THE DRAWINGS

FIG. 6 is another form of elastomer ring with radially displaced triangular openings rather than cylindrical openings of the kind shown in FIGS. 3A and 3B.

FIG. 7 is another form of elastomer ring with angularly offset bridge portions.

FIG. 8 is another construction for the elastomer ring which includes triangular openings situated in tangentially adjacent relationship.

FIG. 8A is a view of the elastomer ring of FIG. 8 after the ring has been compressed following the processing or curing operation.

PARTICULAR DESCRIPTION OF THE INVENTION

Figure 1:
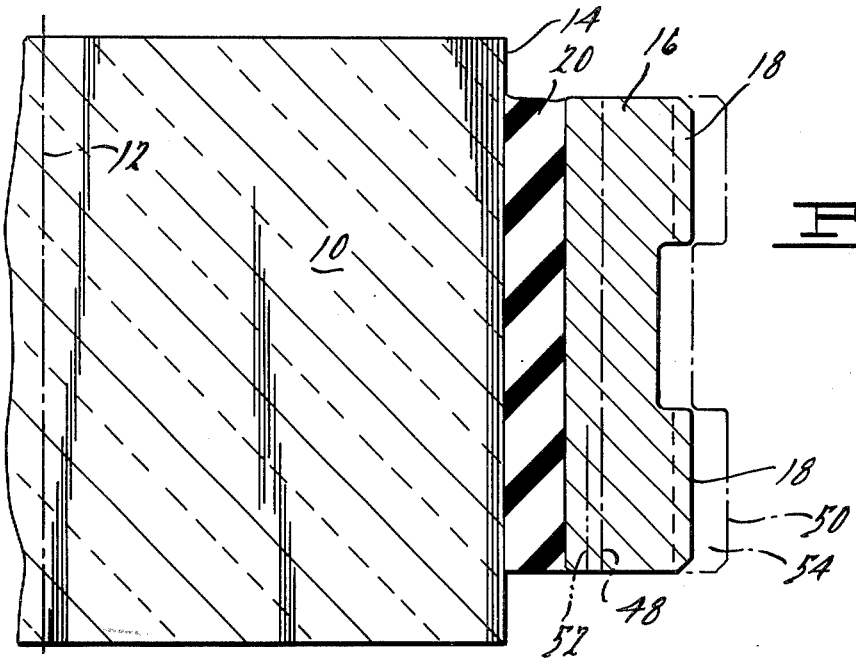
Prior Art FIG. 1.
FIG. 1 shows a radial cross-sectional view of a ceramic regenerator core and ring gear assembly, together with an elastomer situated between them. This is an illustration of a typical prior art construction.

FIG. 1 shows a regenerator core and ring gear construction of the kind found in the prior art. The assembly includes a glass crystal regenerator core 10 of cylindrical form which is adapted for rotation about its geometric axis 12. The periphery of the regenerator core 10, which is designated by reference character 14 is surrounded by a drive ring 16 on which is formed ring gear teeth 18. An elastomer 20 is disposed between the drive ring 16 and the periphery 14 of the core 10. The elastomer may comprise a resin such as Dow-Corning No. 95-077GA or Silastic GA, which are commercially available resins. The resin is compounded with glass fibers such as owens corning No. 497, that are chopped to lengths of approximately one-quarter inch. The glass fibers are coated with a primer, such as Q-36-061, by soaking the fibers in the primer and drying them in still air for about ten hours. The coated fibers then are mixed with zinc oxide and carbon black and blended with the resin in a low energy blender for about 15 minutes. Following the blending, the compound should be of uniform constituency with no aeration. The compound may be stored in an air tight container in a cool place, but it should not be stored for longer than 6 months.

A curing agent should be added to the compound and blended for 15 minutes in a low energy blender with minimum aeration and with no appreciable increase in temperature. Temperature rise can be avoided by external cooling, if necessary. The blended elastomer can be degassed by subjecting it to a vacuum for approximately 45 minutes to one hour, and then it is ready for packaging into a suitable injection nozzle device. An air-operated caulking gun may be used for this purpose. If desired, the regenerator rim can be stress relieved by cutting a series of relief stresses in the periphery of the rim using a diamond cut-off wheel. This operation should be carried out without coolant and the slots should be thoroughly cleaned by blowing filtered, oil-free, compressed air through them, and the slots then can be filled with suitable filler material to make the regenerator rim free of any loose material. The rims' outside diameter may be coated with Carborundum QF180 ceramic cement.

A primer such as Dow-Corning Q-36-061 diluted with trichloroethylene should be applied to the regenerator outside diameter surface by means of a soft-bristled brush. The primer should be air dryed for at least an hour at room temperature. The gear should be wiped clean, degreased and slowly heated to a temperature of about 600° F. on a flat surface in circulating air and held at that temperature for at least an hour in order to expel any occuled gases from the gear surfaces and to relieve machining stresses. The inside diameter surface of the degreased gear should be cleaned by wire brushing to remove any loose oxide and then rinsed with isopropyl alcohol and dryed with filtered, oil-free compressed air.

The partially degreased gear should be grit blasted to expose the fresh metal.

Figure 9:
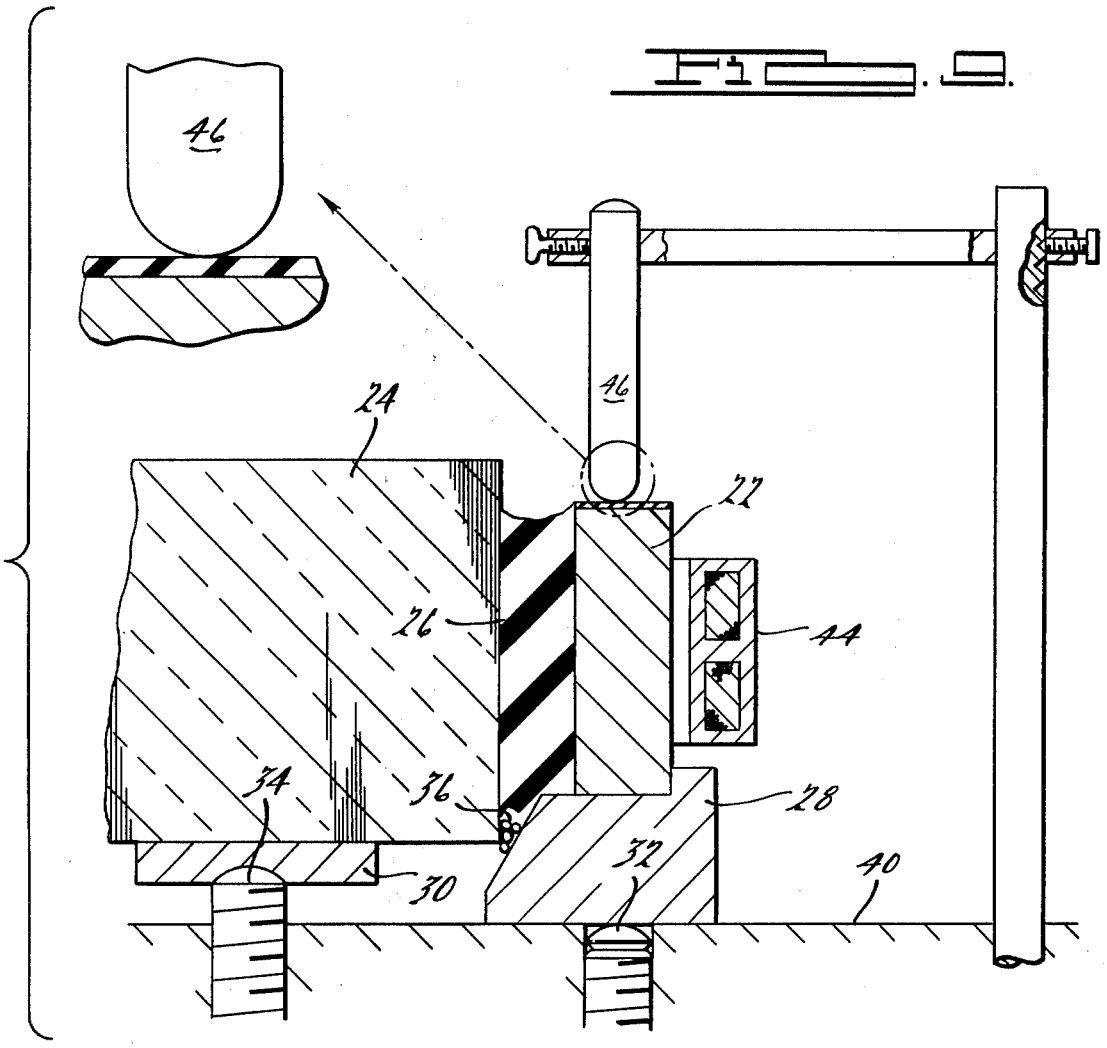
FIG. 9 is a fixture used in the processing of the regenerator ring gear assembly.

The primer, previously identified, then is applied to the inside diameter surface of the gear is installed in a fixture such as that shown in FIG. 9.

In FIG. 9, the gear is shown at 22 and the core is shown at 24. The elastomer 26 is located between the periphery of the core 24 and the inside diameter of the ring gear 22. The ring gear support 28, which is annular in form, supports the gear 22 and the corresponding support 30 supports the core 24. A suitable gear adjustment, schematically shown at 32, adjusts the position of the gear 22 with respect to the core; and a corresponding threaded core adjustment, schematically shown at 34, appropriately positions the core. When the gear and the core are mounted in this fashion, an annular space is provided between the core and the ring gear to permit entry of the elastomer. The bottom of the support 28 and the regenerator OD should be sealed off by means of an asbestos ring 36 to prevent leakage of the elastomer.

Figure 2:
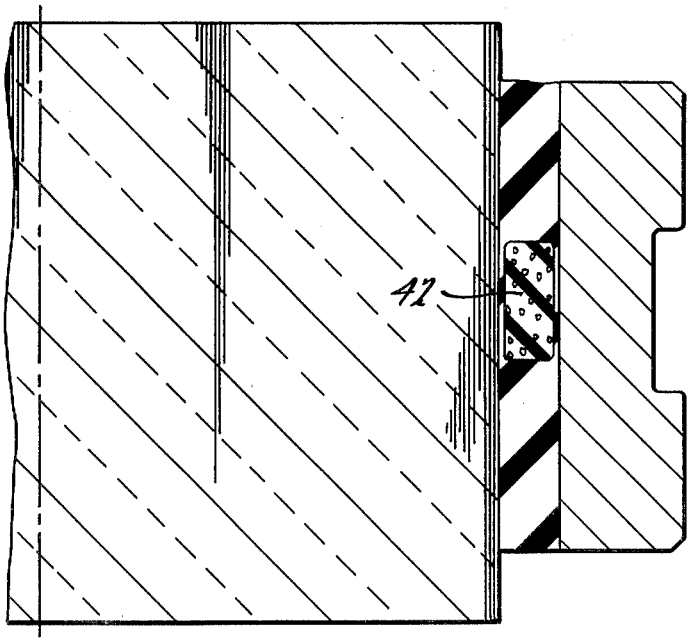
FIG. 2 is a radial cross-sectional view of a regenerator core and ring gear assembly wherein a sponge insert is used to provide a cavity in the elastomer that increases the compliance of the elastomer.

The fixture is adapted to accommodate radial growth of the gear with respect to the support surface 40 as well as with respect to the regenerator core. The elastomer is injected into the annular space by means of a nozzle and the elastomer is applied in layers that are built up slowly with a minimum of air entrapment. A sponge insert such as that shown at 42 in FIG. 2 may be inserted into the annular space after an appropriate amount of elastomer is injected. After the elastomer is injected the gear should be rapidly induction heated using induction heaters 44 at a curing temperature of about 450° for 1½ to 2 minutes, which permits the gear to expand and to stabilize while the elastomer is still at room temperature. As the gear expands, the level of the elastomer will fall, in which case additional elastomer may be injected.

The gear should be maintained at a temperature of about 450° for a total of 20 minutes and then the induction coil should be turned off. At the end of that time the elastomer should be sufficiently hard to permit the assembly to be taken out of the fixture and allowed to cool. The assembly then is ready for post curing. This is done by heating the elastomer to about 400° for ½ hour to 1 hour in an air circulating oven and post cured for at least 3 hours followed by air cooling. A film of polyvinylchloride of a thickness of about 0.005 inches is applied to the periphery of the ring gear as indicated in FIG. 9. The thickness can be gauged by a ceramic rod 46.

The presence of the sponge insert 42 reduces stresses on the glass fibers on the regenerator core during the curing operation due to the differential expansion of the ring gear at the core during curing as well as during the differential expansion that occurs when the regenerator is acting under service temperatures. In FIG. 1 the position shown in full lines represents the normal position of the gear and core at room temperature. During curing temperature, which is about 450° F., the inside diameter of the ring gear moves to the position identified by dotted line 48; and the dotted line 50 represents the outside diameter of the gear. The position of the inside diameter and the outside diameter of the ring gear are shown, respectively, at 52 and 54 when the assembly is post cured at 400° F. This is approximately the operating temperature when the regenerator is in service.

Figure 3:
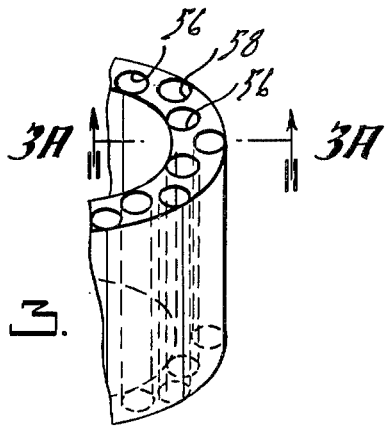
FIG. 3 is an isometric view of an elastomer ring for a generator core and ring gear assembly wherein axial openings are formed in the elastomer throughout the periphery of the regnerator and wherein the openings are offset radially with respect to each other in alternating fashion.
Figure 3A:
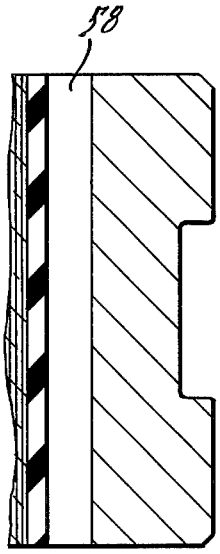
FIG. 3A is a cross-sectional view of the structure of FIG. 3 as seen from the plane of section line 3A—3A of FIG. 3. The ring gear and core are seen in FIG. 3A although these elements are not shown in FIG. 3 for purposes of emphasis.
Figure 9A:
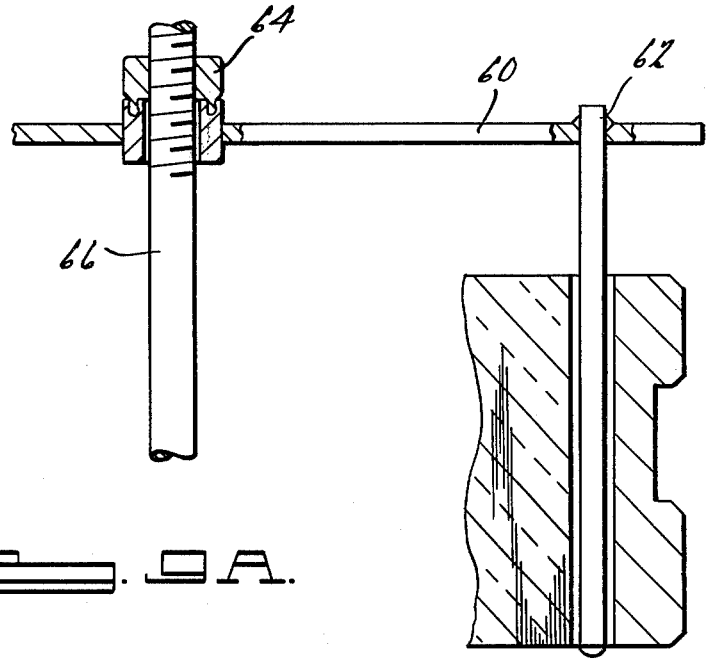
FIG. 9A is a fixture for forming axial openings in the elastomer in a regenerator core and ring gear assembly during the processing thereof.

FIG. 3 I have shown in isometric form an elastomer ring with axially-disposed, cylindrical passages arranged in tangentially spaced relationship adjacent the bond interface between the elastomer and the ceramic regenerator periphery. A second series of axially disposed cylindrical openings 58 are disposed between each pair of openings 56 in proximity to the bond interface between the elastomer and the inside diameter of the ring gear. These openings may be formed with a fixture of the type that is shown in FIG. 9A, which may be used in conjunction with the fixture shown in FIG. 9. The fixture of FIG. 9A comprises a supporting plate 60 and the holes through which teflon coated ceramic rods 62 are positioned. The disc is mounted in parallel disposition with respect to the outward surface of the ceramic regenerator core, and it may be provided with a suitable height adjustment screw 64 at its central axis. The plate is supported by a shaft 66, which extends through the center of the regenerator core.

The ceramic rods are placed in the annular space between the core and the ring gear prior to the injection of the elastomer. They will form the openings 56 and 58 after the elastomer is cured. The teflon coating on the rods permit them to be withdrawn following the curing operation. As a result of the openings 56, 58 and the distribution pattern shown in FIG. 3, mechanical stresses due to the differential rates of thermal expansion of the core and the ring gear are reduced substantially; and the reduced stresses are distributed evenly throughout the periphery of the core thereby preventing cracking of the core. The elastomer is capable, however, of distributing driving torque from between the ring gear and the core as a result of the bonding action of the elastomer with respect to the peripheral surface of the core and the inner peripheral surface of the ring gear.

Figure 4:
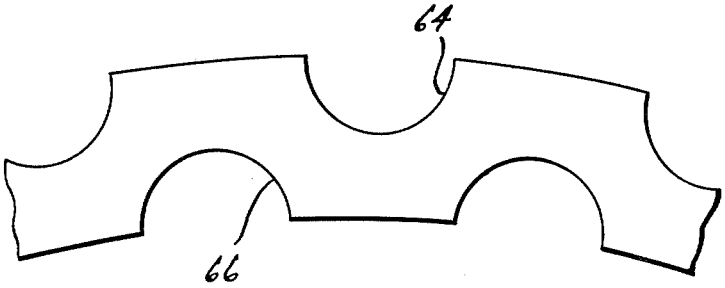
FIG. 4 is an end view of an elastomer ring of the kind shown in FIG. 3, although it is formed with axially directed openings of semi-circular cross section arranged in offset radial disposition, one with respect to the other, in alternating fashion.

A variation of the elastomer ring construction of FIG. 3 is shown in FIG. 4 where cross-sections of the openings are semi-circular rather than circular. This provides an added cushioning action although the surface areas of the bond between the elastomer and the surface of the core and the bond between the elastomer and the surface of the gear is reduced.

Figure 3B:
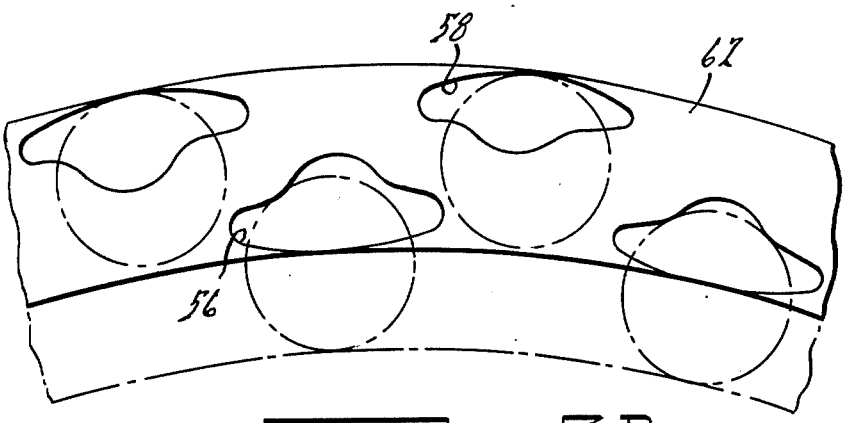
FIG. 3B is a view of a regenerator core and ring gear assembly of the kind shown in FIG. 3A, but it illustrates the elastomer and the condition of the axial openings in it after the ring gear and core have been processed and cured.

FIG. 3B shows the position of the elastomer 62 after the regenerator ring and core assembly has been cooled to room temperature. The passages 56 and 58 are collapsed so that they form a shape substantially as shown in FIG. 3B. There is no direct, radial force transmitting path between the ring gear and the core. Any forces that are transmitted between the ring gear and the core are transmitted in an oblique direction rather than a radial direction.

Figure 4A:
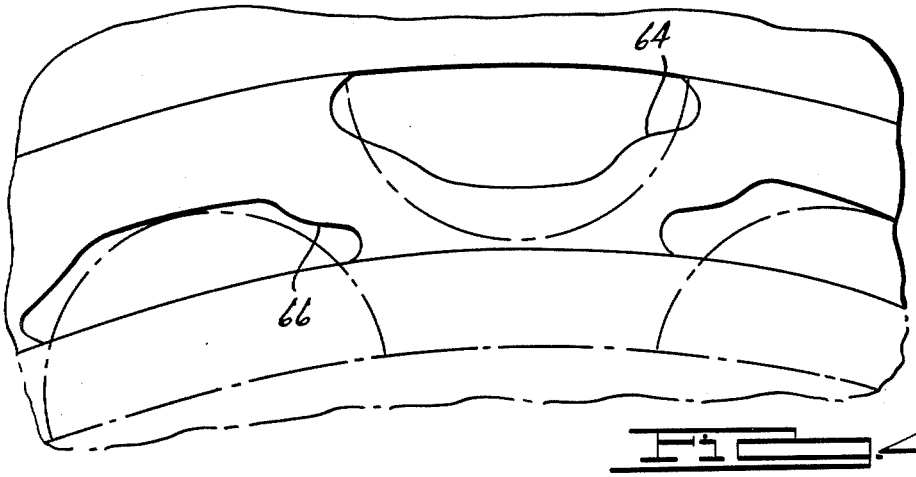
FIG. 4A is a view of the elastomer ring of FIG. 4 after the ring gear and core are processed and cured.

In FIG. 4A I have shown axial openings 64 at the bond interface between the elastomer and the ring gear and openings 66 at the bond interface between the elastomer and the core. The original position of these openings 64 and 66 are shown in FIG. 4. The shape shown in FIG. 4A is that which occurs following the cooling of the regenerator ring and core. Again the forces are transmitted between the core and the ring gear in an oblique direction rather than in a radial direction, and the stress introduced to the ceramic fibers of the regenerator core is reduced accordingly.

Figure 5:
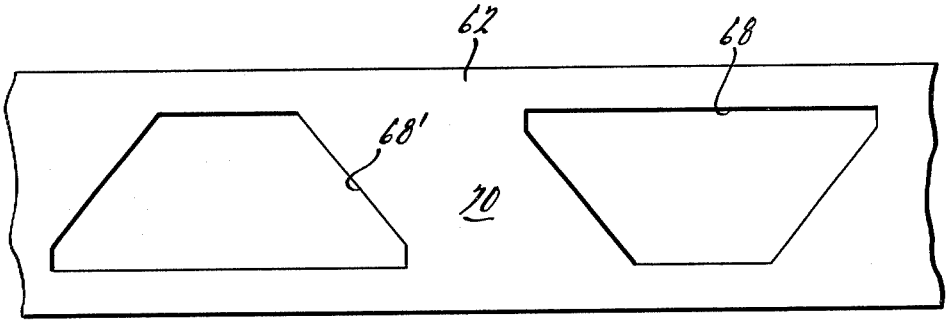
FIG. 5 shows an alternate construction for the elastomer ring which includes trapezoidal-shaped openings rather than cylindrical openings.

Other geometries for the regenerator elastomer rings may be used, another example being shown in FIG. 5 where the openings are generally trapezoidal in shape, as shown at 68. Each opening 68 has a companion, the opening 68', which is inverted in position with respect to the position of opening 68, thereby providing an offset beam portion 70 between the regenerator ring and the regenerator core across which the forces are distributed.

In the embodiment of FIG. 6 I have shown still another geometric variation that may be used. It comprises a series of triangular or trapezoidal-shaped openings 72 in an elastomer ring 74. These are arranged in adjacent juxtaposed relationship with respect to a series of openings 76 located adjacent the regenerator core side of the ring. The opening 72 is located closer to the ring gear portion of the assembly. I have shown also in FIG. 6 a vector diagram which illustrates the direction of distribution of the forces between the regenerator ring gear and the core. See, for example, vectors 78 and 80 which are distrubuted into oblique components 82 and 84, respectively. The corresponding vector for the force at the bond interface of the regenerator core and the elastomer is shown at 86 and 88.

FIG. 7 shows still another geometric variation of an elastomer ring. It comprises a series of relatively large axially disposed openings 90 and 92 and a relatively narrow beam 94 situated between the openings 90 and 92. Each opening is in the form of a trapezoid and adjacent openings are inverted one with respect to the other, and the beam 94 is deformed with a permanent set following curing at room temperatures so that the beam 94 is designed to collapse or yield at a lower force level as differential expansion occurs. Note the curvature of the beam identified by reference character 96.

FIG. 8 shows still another geometric configuration for the elastomer ring to provide added compliance as differential expansion occurs. This ring, which is identified by reference numeral 98, comprises triangular openings 100 and 102 situated in alternating, reverse positions, one with respect to the other, around the periphery of the regenerator core, the radial height of the triangular shapes being only slightly less than the radial thickness of the elastomer ring.

In the elastomer ring construction shown in FIG. 8A a reduced area for the bond interface between the gear and the elastomer ring is provided as shown at 104. The corresponding bond interface of the core side of the ring is shown at 106 and it too is of reduced size with respect to the area of the bond interface and the other constructions. The elastomer ring itself, which is shown at 108, assumes the deformed position shown at FIG. 8A after the curing operation and the assembly assumes room temperature.

Both the radial force transmitting ability and the tangential shear force driving capability of the elastomer ring are reduced in the embodiment shown in FIG. 8A relative to the other embodiments.

Figure 10:
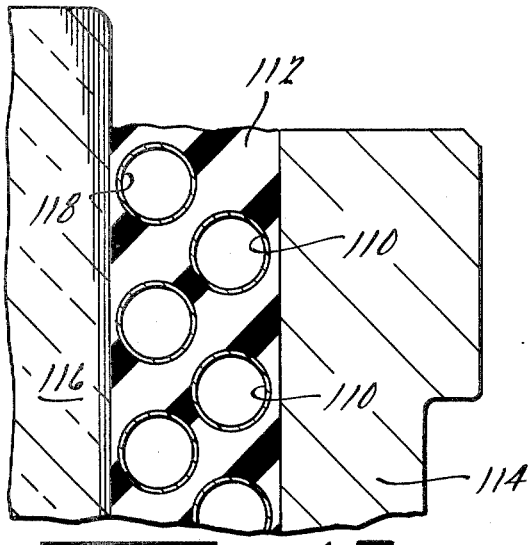
FIG. 10 shows a regenerator core and ring gear assembly with a compliant elastomer ring wherein tangential openings are provided using shrink tubing.

In FIG. 10 I have shown an alternate construction wherein the openings, rather than being axially formed, are disposed tangentially. In FIG. 10, for example, cylindrical openings 110 are formed in elastomer ring 112 between ring gear 114 and the core 116. These are located relatively close to the ring gear, and corresponding tangentially disposed openings 118 are disposed relatively close to the core. The openings 118 are situated intermediate the openings 110, and vice-versa.

Figure 10A:
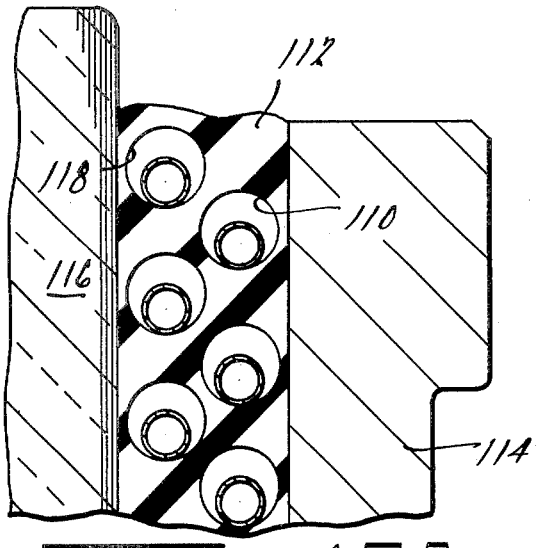
FIG. 10A shows the construction of FIG. 10 after the curing operation.

The openings 110 are formed by inserting polyvinylchloride tubing into the annular space located between the ring gear and the core that occurs when the core and the ring gear are mounted in the fixture as shown in FIG. 9 prior to the injection of the elastomer. The tubing, during the curing operation, shrinks as shown in FIG. 10A thereby leaving a cavity. The tubing diameter as seen in FIG. 10A is actually less than the tubing diameter seen in FIG. 10 although the size of the openings 110 and 118 may be substantially the same for any given curing temperature.

FIG. 10A shows the tubing in the condition that exists just before curing begins, and FIG. 10A shows the same assembly after curing is completed but while the curing temperature remains. After the assembly is cooled to room temperature, the openings 110 and 118 assume the shape shown in FIG. 10B as the ring gear shrinks in radial dimension relative to the ceramic core.

Figure 11:
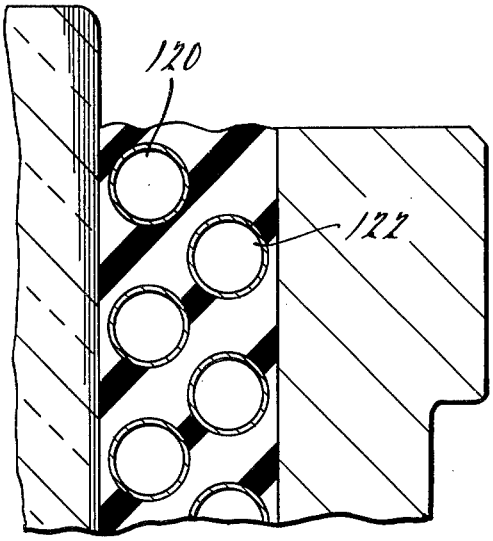
FIG. 11 is a ceramic regenerator core and ring gear assembly wherein an elastomer ring and spherical openings therein is bonded to the ring gear and the core.
Figure 11A:
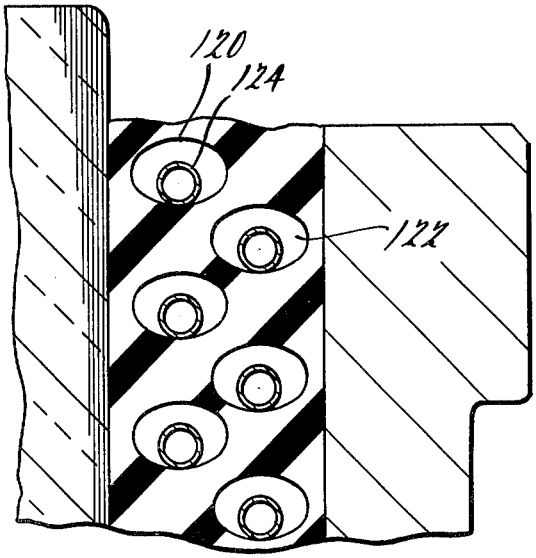
FIG. 11A is a side view similar to FIG. 11 showing the shape of the spherical openings in the elastomer after the curing operation.

It is contemplated that the elastomer ring may be formed with spherical openings as indicated in 120 and 122. These can be either in the pattern shown or they may be randomly positioned. They are formed by inserting elastomeric spheres or balls in the annular space between the ring gear and the core prior to the injection of the elastomer into the space. The elastomer surrounds the elastomeric spheres, and prior to curing the balls produce the spaces as shown in FIG. 11. These spheres may be formed of the same material as the shrink tubing, such as polyvinylchloride, so that at post curing temperatures or during operation at service temperatures the spheres will become reduced in size as shown in FIG. 11A. The presence of the openings 120 and 122 produces the same results as the presence of the openings 110 and 118 in the FIG. 10 embodiment. That is, the compliance of the ring is increased and the stress on the glass fibers of the regenerator core is reduced and are more evenly distributed.

Figure 12:
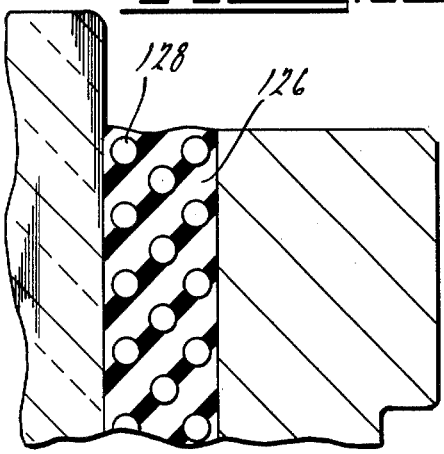
FIG. 12 is a view of a regenerator core and ring gear assembly with an elastomer that is provided with spherical openings formed by elastomeric shells dispersed throughout the elastomer.
Figure 12A:
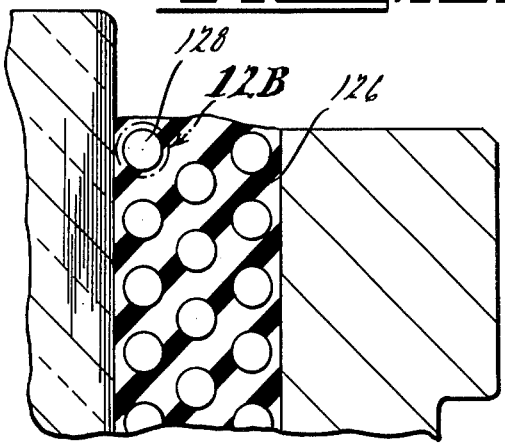
FIG. 12A is a view similar to FIG. 12 wherein the elastomeric shells are expanded as the regenerator core and ring gear assembly operate at service temperatures.
Figure 12B:
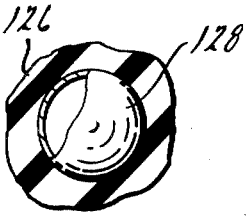
FIG. 12B is an enlargement of a portion of FIG. 12A.

In the embodiment shown in FIGS. 12 and 12A there is provided an elastomeric ring 126 with a plurality of spherical openings 128 dispersed at random throughout the elastomeric material. These openings are formed by using elastomeric shells that are introduced into the annular space between the ring gear and the core prior to injection of the elastomeric material. The elastomeric shell expands as indicated in the diagram in FIG. 12A when the elastomeric ring operates at surface temperatures.

Figure 10B:
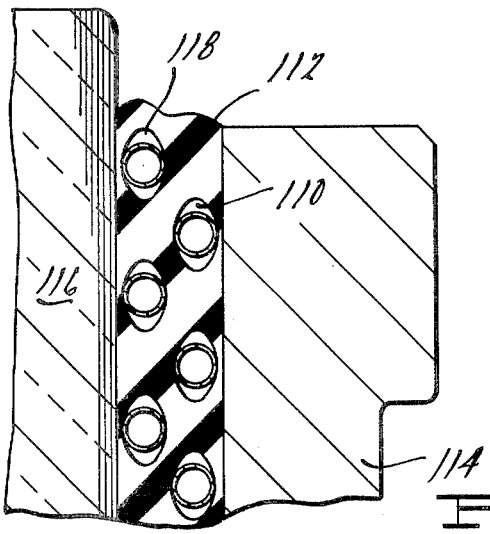
FIG. 10B is a view of the structure of FIG. 10 after the assembly has been returned to room temperature following curing.

In both the embodiment shown in FIG. 12 and 12A, on the one hand, and in the embodiment of FIGS. 10, 10A and 10B, on the other hand, glass tubes or glass spheres may be used rather than the shrink tubing or the polyvinylchloride shells. After the curing operation of the elastomer and the assembly is returned to room temperature, the shrinkage of the ring gear will cause the glass shells to crush thereby leaving a cavity of the kind shown in FIGS. 10, 10A and 10B or in FIGS. 12 and 12A.

Figure 13:
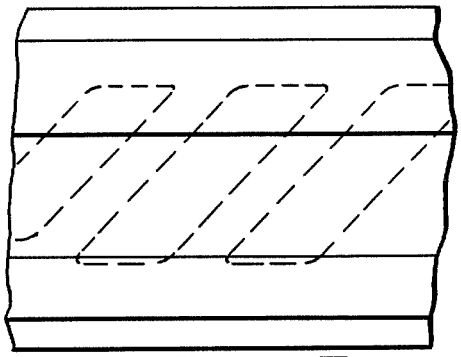
FIGS. 13–15A are views of alternate constructions using sponge cushions in the elastomer.
Figure 13A:
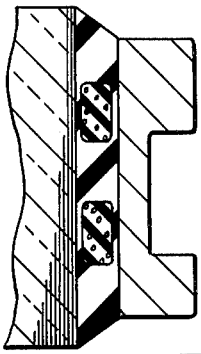
Figure 14:
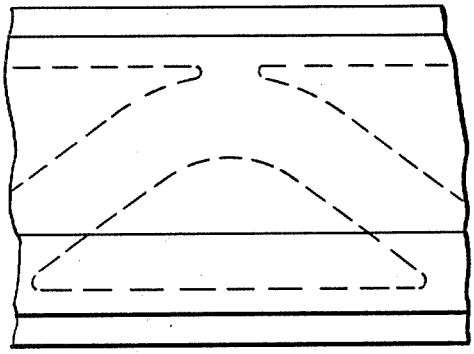
Figure 14A:
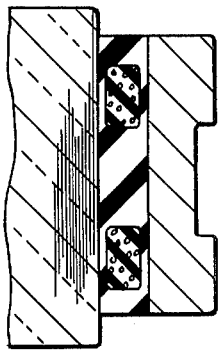
Figure 15:
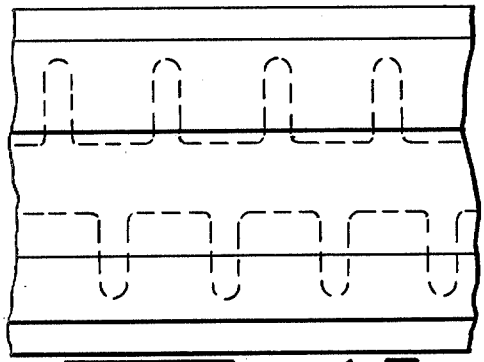
Figure 15A:
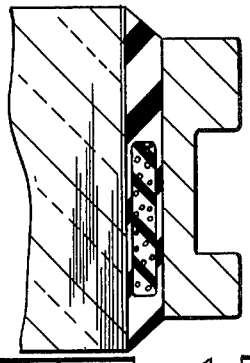

FIGS. 12 and 13A, FIGS. 14 and 14A and FIGS. 15 and 15A show other embodiments of the elastomer ring. In FIGS. 13 and 13A elongated sponges are arranged in a chevron pattern to provide increased compliance. The same effect can be obtained by using a triangular pattern as in FIGS. 14 and 14A or a branched pattern as shown in FIGS. 15 and 15A. FIGS. 13A, 14A and 15A are cross-sectional views of the structures shown, respectively, in FIGS. 13, 14 and 15.

Having described preferred forms of the invention, what is claimed is:

1. A process for forming a regenerator assembly comprising the steps of mounting a glass ceramic cylindrical regenerator core and a metallic ring in a fixture with the ring surrounding the periphery of the core in radially spaced relationship, an annular space thus being defined between the periphery of the core and the inside diameter of the ring, inserting in the annular space at least one heat shrinkable element, injecting elastomeric material in the annular space surrounding said element, and curing said elastomeric material with heat to shrink said element and form a cavity in said elastomeric material to form a torque transmitting path between the ring and the core with sufficient compliance to resist development of excessive stresses in the core.

2. The process as set forth in claim 1 wherein the step of injecting elastomeric material into said annular space is preceded by the steps of blending glass fibers with the elastomeric material and, cleaning and priming the surface of the core and the surrounding surface of the ring.

3. The process as set forth in claim 1 wherein said element is in the form of tubing arranged in tangential disposition around the periphery of said core and in a geometric pattern that allows one tubing portion to be radially offset with respect to the other, whereby a direct radial force transmitting path between the ring and the core is interrupted by the spaces, the force distribution pattern thereby including oblate force vectors as radial and tangential forces are distributed through the elastometric material.

4. The process as set forth in claim 3 wherein the step of injecting elastomeric material into said annular space is preceded by the steps of blending glass fibers with the elastomeric material and cleaning and priming the surface of the core and the surrounding surface of the ring.

5. The process as set forth in claim 1 wherein the step of injecting the elastomer is preceded by the step of inserting in the annular space surrounding the core a plurality of spheres formed of heat shrinkable material, said spheres when surrounded with elastomeric material creating cavities in the elastomeric material as the elastomeric material is cured.

6. The process as set forth in claim 5 wherein the step of injecting elastomeric material into said annular space is preceded by the steps of blending glass fibers with the elastomeric material and cleaning and priming the surface of the core and the surrounding surface of the ring.

* * * * *